US011479902B2

(12) United States Patent
Kim et al.

(10) Patent No.: US 11,479,902 B2
(45) Date of Patent: Oct. 25, 2022

(54) APPARATUS FOR TREATING LAUNDRY

(71) Applicant: LG ELECTRONICS INC., Seoul (KR)

(72) Inventors: Sungyong Kim, Seoul (KR); Jinwoong Kim, Seoul (KR); Kilryong Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 180 days.

(21) Appl. No.: 16/547,453

(22) Filed: Aug. 21, 2019

(65) Prior Publication Data

US 2020/0063316 A1 Feb. 27, 2020

(30) Foreign Application Priority Data

Aug. 23, 2018 (KR) ..... 10-2018-0098618
Aug. 23, 2018 (KR) ..... 10-2018-0098665

(51) Int. Cl.
*D06F 39/08* (2006.01)
*D06F 37/04* (2006.01)

(52) U.S. Cl.
CPC ..... *D06F 39/083* (2013.01); *D06F 37/04* (2013.01); *D06F 39/088* (2013.01)

(58) Field of Classification Search
CPC ..... D06F 37/265; D06F 37/266; D06F 39/02; D06F 39/022; D06F 39/08; D06F 39/083; D06F 39/088
See application file for complete search history.

(56) References Cited

U.S. PATENT DOCUMENTS 4,162,546 A * 7/1979 Shortell ..... E03C 1/12 4/696
2003/0037382 A1 2/2003 Broker
(Continued)

FOREIGN PATENT DOCUMENTS

CN 1760425 A 4/2006
CN 1773000 A 5/2006
(Continued)

OTHER PUBLICATIONS

European Patent Search Report issued in counterpart European Application No. 19192759.9-1018 dated Nov. 18, 2019 (12 pages).
(Continued)

*Primary Examiner* — Spencer E. Bell
(74) *Attorney, Agent, or Firm* — Birch, Stewart, Kolasch & Birch, LLP

(57) ABSTRACT

The present invention relates to an apparatus for treating laundry, including a cabinet having an entrance for inserting laundry and a door opening and closing the entrance, a tub positioned in the cabinet and having an opening for allowing the laundry to pass through, a drum rotatably positioned in the tub to receive the laundry, a vibration insulating part maintaining a watertight seal by connecting the entrance and the opening, a balance weight positioned in a front side of the tub to increase a weight of the tub, and an annular passage part extending between the vibration insulating part and the balance weight, the annular passage part fixedly supported by the balance weight, the annular passage part having a plurality of nozzles spraying wash water into the drum through the vibration insulating part.

17 Claims, 13 Drawing Sheets

(56) References Cited

U.S. PATENT DOCUMENTS

| | | | | |
|---|---|---|---|---|
| 2004/0025544 | A1 | 2/2004 | Kim et al. | |
| 2009/0249840 | A1 | 10/2009 | Jo et al. | |
| 2011/0083477 | A1 | 4/2011 | Kim et al. | |
| 2011/0088172 | A1* | 4/2011 | Im | D06F 37/267 8/137 |
| 2013/0026895 | A1 | 1/2013 | Gweon et al. | |
| 2015/0082838 | A1* | 3/2015 | Gweon | D06F 37/265 68/139 |
| 2017/0211223 | A1 | 7/2017 | Cho et al. | |
| 2020/0141045 | A1* | 5/2020 | Seo | D06F 37/22 |

FOREIGN PATENT DOCUMENTS

| | | | | |
|---|---|---|---|---|
| CN | 101824726 | A | 9/2010 | |
| CN | 102234897 | A | 11/2011 | |
| CN | 102639776 | A | 8/2012 | |
| EP | 2343409 | A1 | 7/2011 | |
| EP | 2 383 382 | A2 | 11/2011 | |
| EP | 2634303 | A1 * | 9/2013 | D06F 39/083 |
| EP | 3 505 675 | A1 | 7/2019 | |
| JP | 2011250921 | A | 12/2011 | |
| KR | 20-1999-0016532 | | 5/1999 | |
| KR | 10-2008-016078 | A | 2/2008 | |
| WO | WO 2018-124786 | A2 | 7/2018 | |

OTHER PUBLICATIONS

PCT International Search Report and Written Opinion issued in counterpart PCT/KR2019/010483 dated Dec. 12, 2019 (12 pages).
Office Action dated May 8, 2021, in Chinese Patent Application No. 201910778109.0 (21 Pages).
Office Action dated Sep. 26, 2021, in Chinese Patent Application No. 201910778109.0 (19 pages).

* cited by examiner

A - A'

B - B'

APPARATUS FOR TREATING LAUNDRY

CROSS REFERENCES TO RELATED APPLICATIONS

Pursuant to 35 U.S.C. § 119(a), this application claims the benefit of earlier filing date and right of priority to Korean Application No. 10-2018-0098618 and No. 10-2018-0098665 filed on Aug. 23, 2018, the contents of which are hereby incorporated by reference herein in their entirety.

BACKGROUND OF THE INVENTION

Field of the Invention

The present invention relates to an apparatus for treating laundry. Although the present invention is suitable for a wide scope of applications, it is particularly suitable for preventing deformation and separation of a water supply passage for supplying wash water.

Discussion of the Related Art

Generally, a laundry treating device means a device capable of cleaning laundry through cycles such as washing, rinsing, dewatering and the like to detach contamination or dirt attached to clothes, bedding and the like (hereinafter named 'laundry') received in a drum using the action of wash water and detergent.

A tub receiving wash water therein is disposed within the laundry treating device, a drum receiving laundry therein is rotatably installed in the tub, and a motor generating a drive force of the drum is installed at one side of the tub.

Moreover, a laundry treating device having a nozzle provided to a front side of a tub is developed and released. Here, the nozzle supplies wash water into a drum and the wash water soaks laundry within the drum by being directly sprayed on the laundry received in the drum.

A wash water inflow pipe and a water supply pipe, which are formed on an outer circumference of a tube for the supply of wash water, are connected to each other through a clamp. In this case, the clamp connects the water supply pipe and the wash water inflow pipe together in a manner of enclosing an outer circumference of the water supply pipe and an outer circumference of the wash water inflow pipe from outsides of the water supply pipe and the wash water inflow pipe.

However, the related art laundry treating device has the following problems due to the above-mentioned structure.

First, since wash water flowing in through an outer circumference of a tub fills the tub from a lower space of the tub by flowing along an inner circumference of the tub and an outer circumference of a drum, there is a problem that a washing or rinsing cycle starts without soaking laundry in the wash water sufficiently.

Specifically, as a washer having a nozzle of the related art sprays water on a single place or in a single direction, there is limitation put on soaking laundry in a drum evenly. Moreover, there is a problem that spray performance is lowered in a place having a low water supply pressure.

Secondly, in a water supply assembly process, while positions of a wash water inflow pipe and a water supply pipe are fixed, a water supply pipe and a wash water inflow pipe are enclosed with a clamp and the clamp is then fastened. Thus, it causes a problem that the assembly job needs a lot of worker's care and more assembly time.

Thirdly, due to thickness of a clamp fixed to outer circumferences of a wash water inflow pipe and a water supply pipe, space utilization is lowered and the water supply pipe collides with an outer surface of a tube or a weight balancer on tub vibration.

SUMMARY OF THE INVENTION

Accordingly, embodiments of the present invention are directed to a laundry treating apparatus that substantially obviates one or more problems due to limitations and disadvantages of the related art.

One object of the present invention is to provide a laundry treating apparatus, by which a water supply structure for supplying wash water into a drum is improved and laundry within the drum is soaked more effectively.

Another object of the present invention is to provide a laundry treating apparatus, by which a wash water spray area in a wider range within a drum is provided.

Another object of the present invention is to provide a laundry treating apparatus, by which a passage for spraying wash water into a drum is simplified.

Another object of the present invention is to provide a laundry treating apparatus, by which a fixed state of a passage for spraying wash water into a drum is improved.

Another object of the present invention is to provide a laundry treating apparatus, by which a fixed state of a nozzle for spraying wash water into a drum is improved.

Another object of the present invention is to provide a laundry treating apparatus, by which an assembly process of a water supply structure is simplified and assembly time is reduced.

A further object of the present invention is to provide a laundry treating apparatus, by which noise is reduced and durability is ensured in a manner of preventing collision between a water supply pipe and a tub or a weight balancer.

Technical tasks obtainable from the present invention are non-limited by the above-mentioned technical tasks. And, other unmentioned technical tasks can be clearly understood from the following description by those having ordinary skill in the technical field to which the present invention pertains.

Additional advantages, objects, and features of the invention will be set forth in the disclosure herein as well as the accompanying drawings. Such aspects may also be appreciated by those skilled in the art based on the disclosure herein.

To achieve these objects and other advantages and in accordance with the purpose of the invention, as embodied and broadly described herein, an apparatus for treating laundry according to one embodiment of the present invention includes a cabinet having an entrance for inserting laundry and a door opening and closing the entrance, a tub positioned in the cabinet and having an opening for allowing the laundry to pass through, a drum rotatably positioned in the tub to receive the laundry, a vibration insulating part maintaining a watertight seal by connecting the entrance and the opening, a balance weight positioned at a front side of the tub to increase a weight of the tub, and an annular passage part extending between the vibration insulating part and the balance weight, the annular passage part fixedly supported by the balance weight, the annular passage part having a plurality of nozzles spraying wash water into the drum through the vibration insulating part.

Preferably, the annular passage part includes an inflow portion supplied with the wash water, an extending portion extending from an end portion of the inflow portion to an outer circumference of the vibration insulating part, and at least one nozzle positioned at the extending portion to spray the wash water into the drum by perforating the vibration insulating part.

Preferably, the extending portion includes first and second extending portions extending to both sides of the outer circumference of the vibration insulating part, respectively and a connecting portion is further positioned between the first and second extending portion and the inflow portion to divergently supply the wash water supplied to the inflow portion to the first and second extending portions.

Preferably, the vibration insulating part includes a diffusion nozzle portion having the nozzle inserted therein, the diffusion nozzle portion diffusing the wash water sprayed from the nozzle when switching a direction of the wash water to an inside of the drum.

Preferably, the diffusion nozzle portion includes a nozzle sleeve having an insertion hole where the nozzle is inserted and a diffusion plate formed on one side of the nozzle sleeve, the diffusion plate diffusing the wash water sprayed from the nozzle when switching the direction of the wash water to the inside of the drum.

Preferably, the nozzle further includes a catch sill held on an end of the nozzle sleeve and inserted in the nozzle sleeve.

Preferably, a plurality of separation preventive ribs configured to increase a frictional force with an inner circumference of the nozzle sleeve are formed on an outer circumference of the nozzle.

Preferably, the balance weight includes a surface pressurizing the annular passage part toward the vibration insulating part by contacting an outer surface of the annular passage part.

Preferably, the annular passage part includes a nozzle configured to spray the wash water into the drum by perforating the vibration insulating part and the surface pressurizes the nozzle toward the vibration insulating part.

Preferably, a fixing rib projected toward the balance weight is formed on an outer surface of the annular passage part and a fastening portion having the fixing rib formed at the balance weight.

Preferably, the fastening portion includes a recessed portion recessed in an inside of the balance weight and having the fixing rib inserted therein and a fastening hole formed in the recessed portion so that a fastening member fixing the fixing rib is inserted in the fastening hole.

Preferably, the apparatus further includes a fastening clip that fastens the fastening member perforating the fastening hole by interposing the fixing rib.

Preferably, the apparatus further includes a water supply pipe for supplying the wash water, a wash water inflow portion positioned at an outer circumference of the vibration insulating part to guide the wash water into the drum, and a connector connecting the water supply pipe and the wash water inflow portion together by being inserted in the water supply pipe and the wash water inflow portion.

Preferably, the connector includes a connector body configured in a hollow pillar shape.

Preferably, the connector further includes a movement preventive sill positioned at the connector body and contacting an end portion of the water supply pipe and an end portion of the wash water inflow portion.

Preferably, the connector further includes a first coupling portion positioned at the connector body coupled to the water supply pipe by being projected from an outer circumference of the connector body.

Preferably, the first coupling portion includes a first coupling projection and the water supply pipe includes a first coupling projection insertion hole having the first coupling projection inserted therein.

Preferably, the first coupling portion includes a first coupling rib continuously protruding along the outer circumference of the connector body.

Preferably, the connector further includes a second coupling portion positioned at the connector body and coupled to the wash water inflow portion by being projected from an outer circumference of the connector body.

Preferably, the second coupling portion includes a second coupling projection, and the wash water inflow portion includes a second coupling projection insertion hole having the second coupling projection inserted therein.

Preferably, the second coupling portion includes a second coupling rib continuously protruding along the outer circumference of the connector body.

Preferably, the apparatus further includes a wash water guider positioned at an inner circumference of the vibration insulating part to form a passage communicating with the wash water inflow portion, the wash water guider bent toward an inner space of the drum, and the connector further includes a guider insertion portion provided at an end of the connector body so as to be inserted in the wash water guider.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

Accordingly, embodiments of the present invention provide various effects and/or features.

In a laundry treating apparatus according to one embodiment of the present invention, a water supply structure for supplying wash water into a drum is improved and laundry within the drum is soaked more effectively as well.

In a laundry treating apparatus according to one embodiment of the present invention, wash water can be sprayed in a wider range within a drum.

In a laundry treating apparatus according to one embodiment of the present invention, a passage for spraying wash water into a drum can be simplified.

In a laundry treating apparatus according to one embodiment of the present invention, a fixed state of a passage for spraying wash water into a drum can be improved.

In a laundry treating apparatus according to one embodiment of the present invention, a fixed state of a nozzle for spraying wash water into a drum can be improved.

In a laundry treating apparatus according to one embodiment of the present invention, an assembly process of a water supply structure can be simplified and assembly time can be reduced.

In a laundry treating apparatus according to one embodiment of the present invention, noise can be reduced and durability can be ensured in a manner of preventing collision between a water supply pipe and a tub or a weight balancer.

Effects obtainable from the present invention may be non-limited by the above mentioned effects. And, other unmentioned effects can be clearly understood from the following description by those having ordinary skill in the technical field to which the present invention pertains.

BRIEF DESCRIPTION OF THE DRAWINGS

The present invention will become more fully understood from the detailed description given herein below and the accompanying drawings, which are given by illustration only, and thus are not limitative of the present invention, and wherein.

DETAILED DESCRIPTION OF THE INVENTION

Reference will now be made in detail to the present invention using drawings and embodiments specifying components of the present invention, which are just used to help the understanding of the present invention.

Terminologies or words used in this specification and claims are not construed as limited to the general or dictionary meanings and should be construed as the meanings and concepts matching the technical idea of the present invention based on the principle that an inventor is able to appropriately define the concepts of the terminologies to describe the inventor's intention in best way. And, the names defined for the respective components may be called other names in the art to which the present invention pertains.

Moreover, specific components in the following embodiments can be illustrated or described exaggeratedly or reducibly for clarity of description, which is just to help the understanding of the present invention.

Therefore, the following embodiments are merely exemplary and are not to be considered as limiting the present disclosure. It will be appreciated by those skilled in the art that various modifications and variations can be made from the disclosure, and the present invention covers the modifications and variations of this invention.

First, a laundry treating apparatus according to an embodiment of the present invention is described in detail with reference to the accompanying drawings. For clarity of the description, wherever possible, the same reference numbers will be used throughout the drawings to refer to the same or similar parts. Moreover, detailed description of the same components of the related art will be omitted but the parts related to the present invention shall be described in detail.

Figure 1:
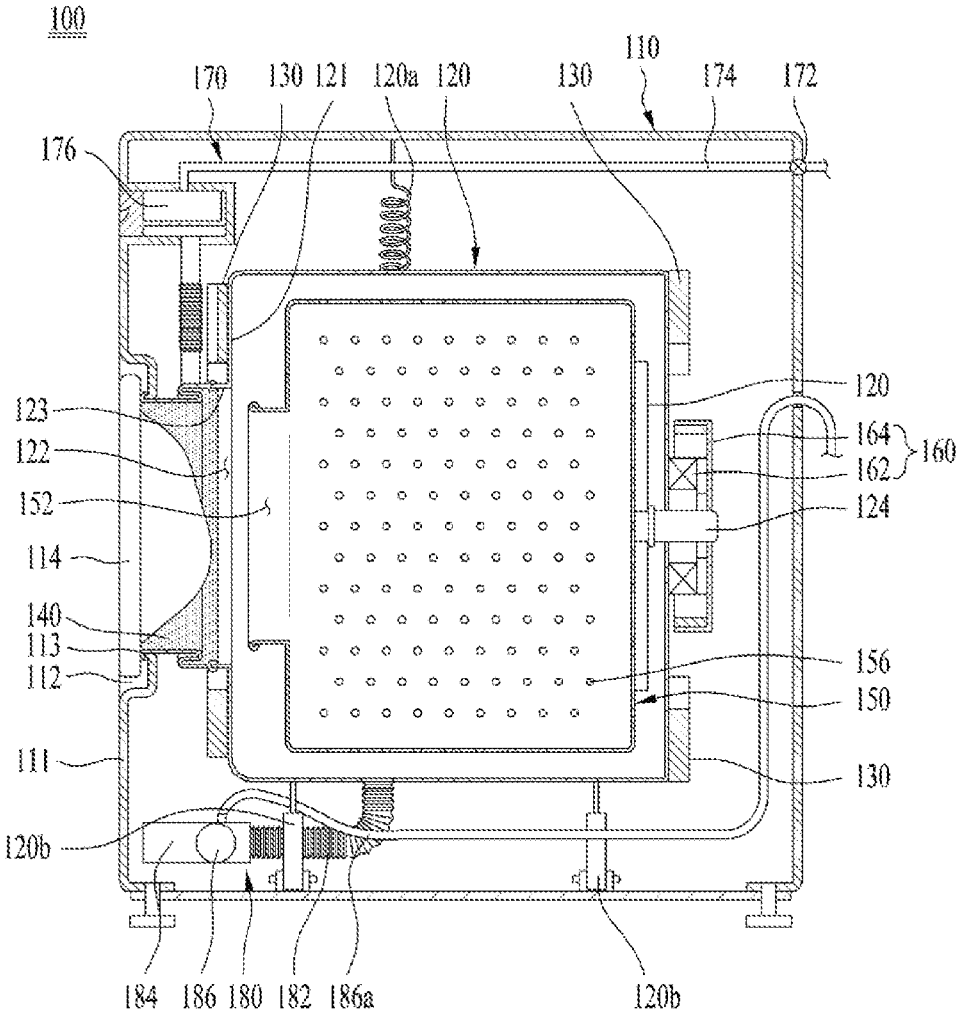
FIG. 1 is a schematic diagram showing an inner structure of a laundry treating apparatus according to an embodiment of the present invention.
Figure 2:
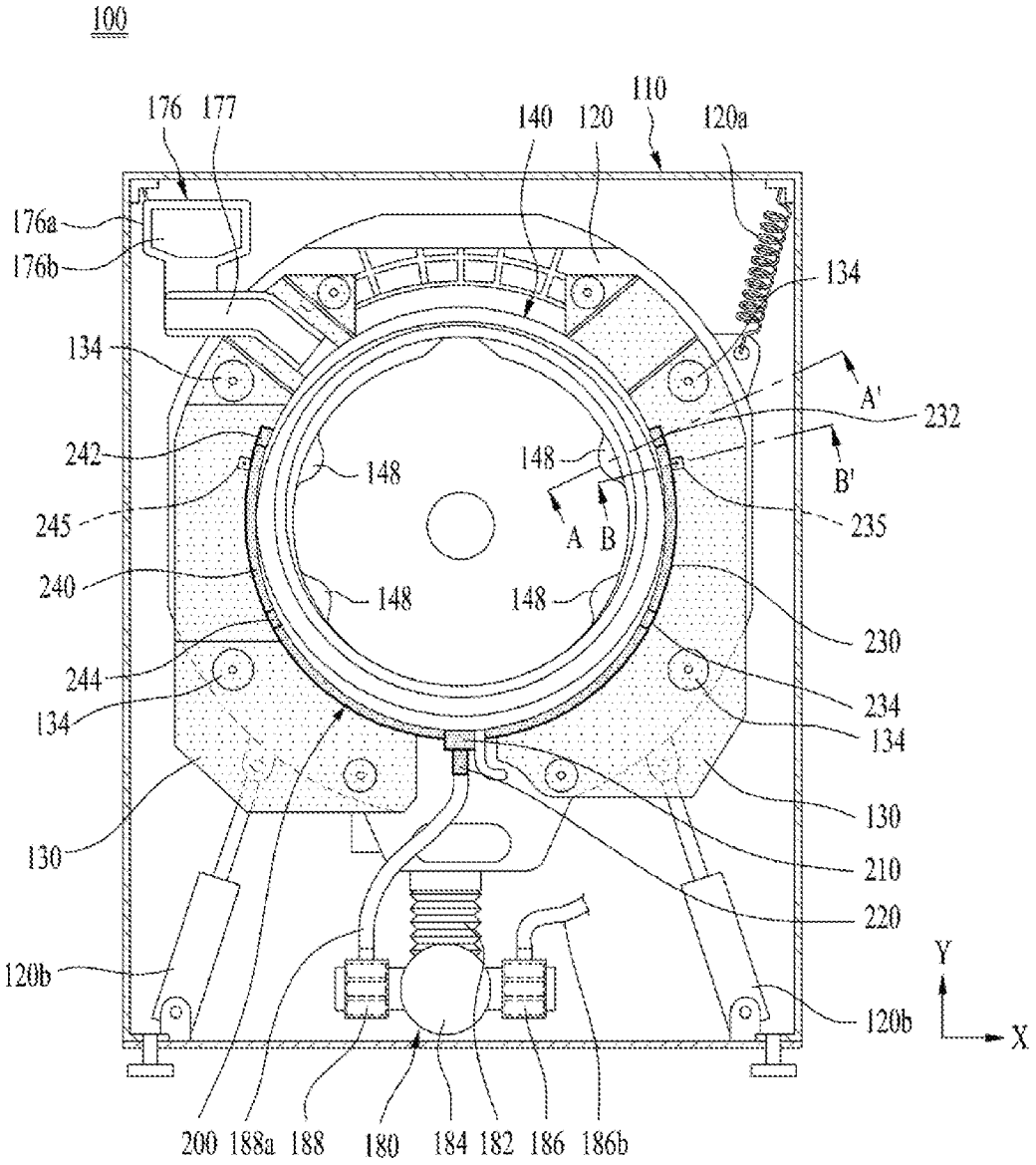
FIG. 2 is a front diagram showing main configuration of a laundry treating apparatus according to an embodiment of the present invention.
Figure 3:
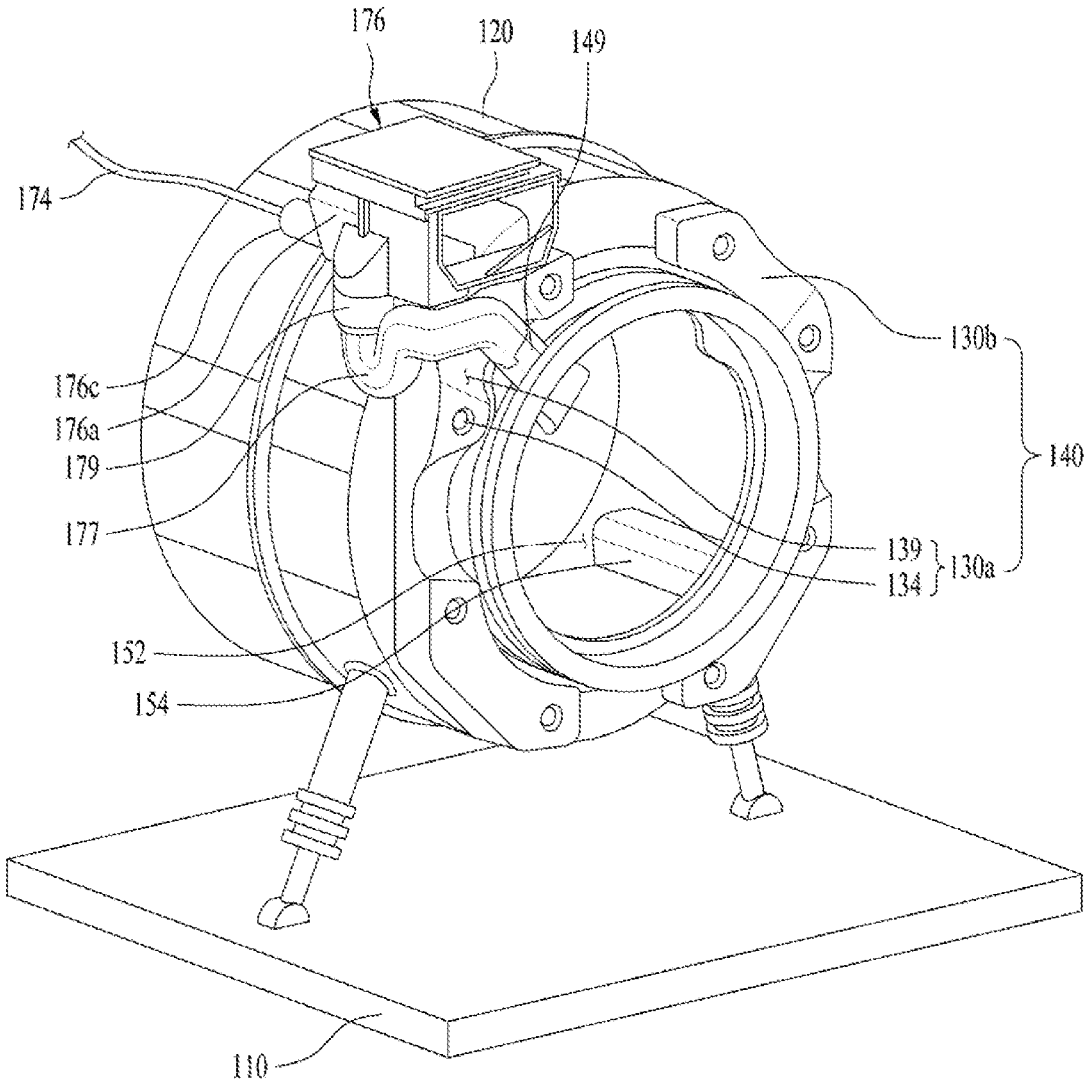
FIG. 3 is a perspective diagram showing main configuration of a laundry treating apparatus according to an embodiment of the present invention.

FIG. 1 is a schematic diagram showing an inner structure of a laundry treating apparatus according to an embodiment of the present invention, FIG. 2 is a front diagram showing main configuration of a laundry treating apparatus according to an embodiment of the present invention, and FIG. 3 is a perspective diagram showing main configuration of a laundry treating apparatus according to an embodiment of the present invention.

Referring to FIGS. 1 to 3, a laundry treating apparatus 100 according to one embodiment of the present invention may include a cabinet 110 forming an exterior, the cabinet 110 in which components configuring the laundry treating apparatus 100 are installed, the cabinet 110 including a front panel 111 having an entrance 112 formed therein to put laundry therethrough, a tub 120 flexibly supported within an inside of the cabinet 110 by a suspension (e.g., damper 120*b* and spring 120*a*) so as to store wash water therein, a drum 150 provided within the tub 120 in a manner rotatable to the tub 120 so as to progress a washing/rinsing/dewatering cycle by having laundry put thereinto, a motor 160 transferring a rotation force to the drum 150 to rotate, a water supply part 170 supplying wash water to the tub 120, a drain part 180 circulating the wash water supplied to the tub 120 and also draining wash water supplied to the tub 120 and completing a washing/rinsing cycle and wash water discharged from laundry in a dewatering cycle, a vibration insulating part 140 provided between the cabinet 110 and the tub 120 to prevent vibration of the tub 120 from being transferred to the cabinet 110, and an annular passage part 200 supplying the wash water supplied from the drain part 180 to a front/rear side within the drum 150 through the vibration insulating part 140.

Figure 5:
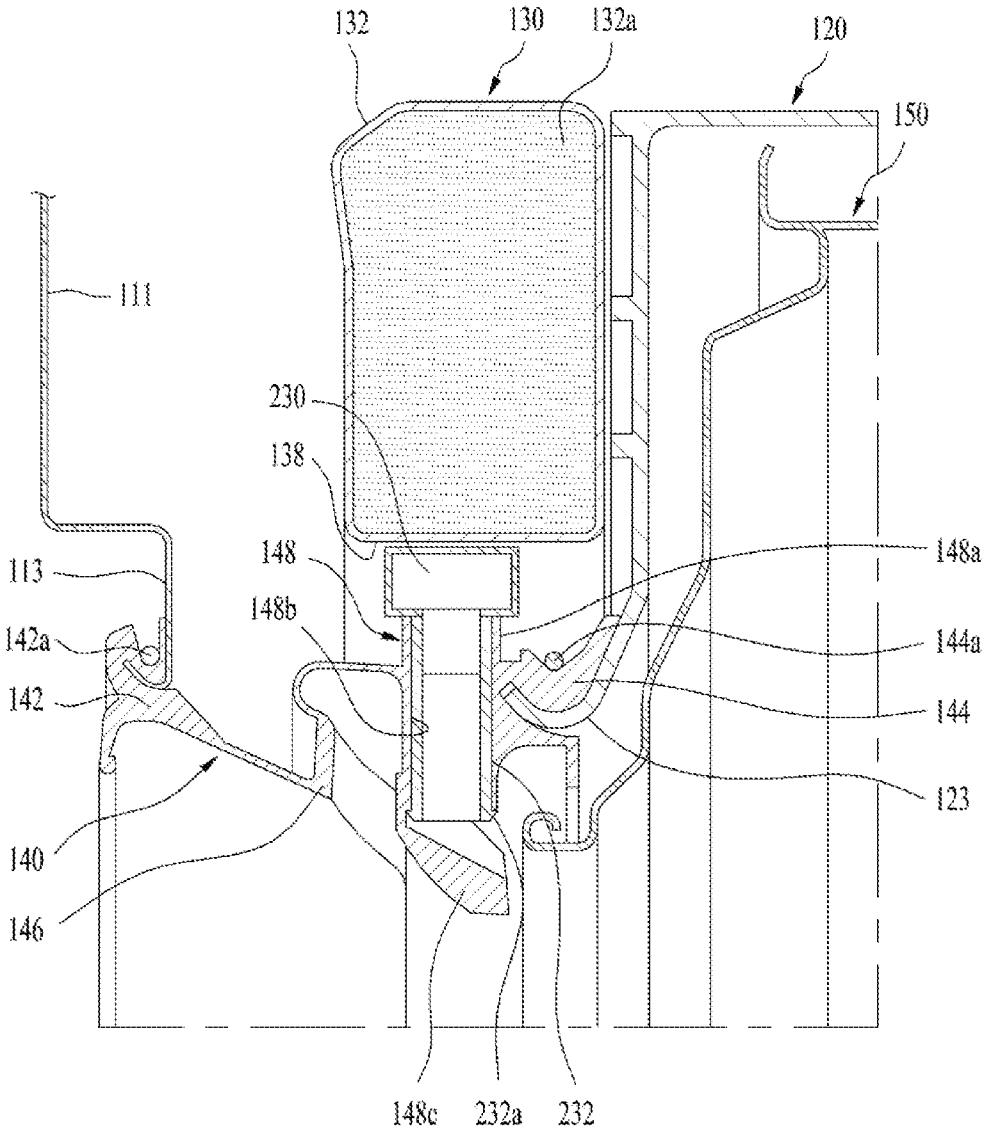
FIG. 5 is a cross-sectional diagram showing an installed state of a nozzle of an annular passage part according to an embodiment of the present invention.

The cabinet 110 includes the front panel 111 forming a front side of the laundry treating apparatus 100 and having an entrance 112 formed therein to put laundry therethrough, and a door 114 configured to open/close the entrance 112 is rotatably installed at the front panel 111. Meanwhile, as shown in FIG. 5, an entrance rim 113 to which a cabinet fastening portion 142 of the vibration insulating part 140 is fastened is provided to the entrance 112.

A control panel (not shown) may be provided to a top end of the front panel 111 of the cabinet 110. The control panel 116 may be provided with a plurality of buttons or knobs to manipulate operations of the laundry treating apparatus 100 and include a display unit for displaying operational statuses of the laundry treating apparatus 100.

Here, directions are defined to help the understanding of the specific configuration of the laundry treating apparatus 100 described in the following. First of all, a direction toward the door 114 with reference to a center of the cabinet 110 may be defined as a front side. And, a direction completely opposite to the direction toward the door 114 may be defined as a rear side. Moreover, right/left side direction may be defined in a manner depending on the above-defined front/rear side direction.

The tub 120 may be installed in a manner that a length-directional axis is side by side with a bottom side of the cabinet 110 or maintains inclination of 0~30° with the bottom side of the cabinet 110. And, the spring 120*a* and the damper 120*b* are provided to top and bottom sides of the tub 120 to attenuate vibration of the tub 120 and to prevent the vibration of the tub 120 from being transferred to the cabinet 110, respectively.

A front face 121 in which a tub opening 122 for putting laundry therethrough is formed is formed in front of the tub 120, and the opening rim 123 to which a tub fastening portion (described later) 144 of the vibration insulating part 140 is fastened is provided to the tub opening 122.

Meanwhile, the vibration insulating part 140 of a bellows type is provided between the tub opening 122 and the entrance 112 of the cabinet 110 to seal a space between the tub 120 and the cabinet 110 and to prevent the vibration of the tub 120 from being transferred to the cabinet 110.

Figure 6:
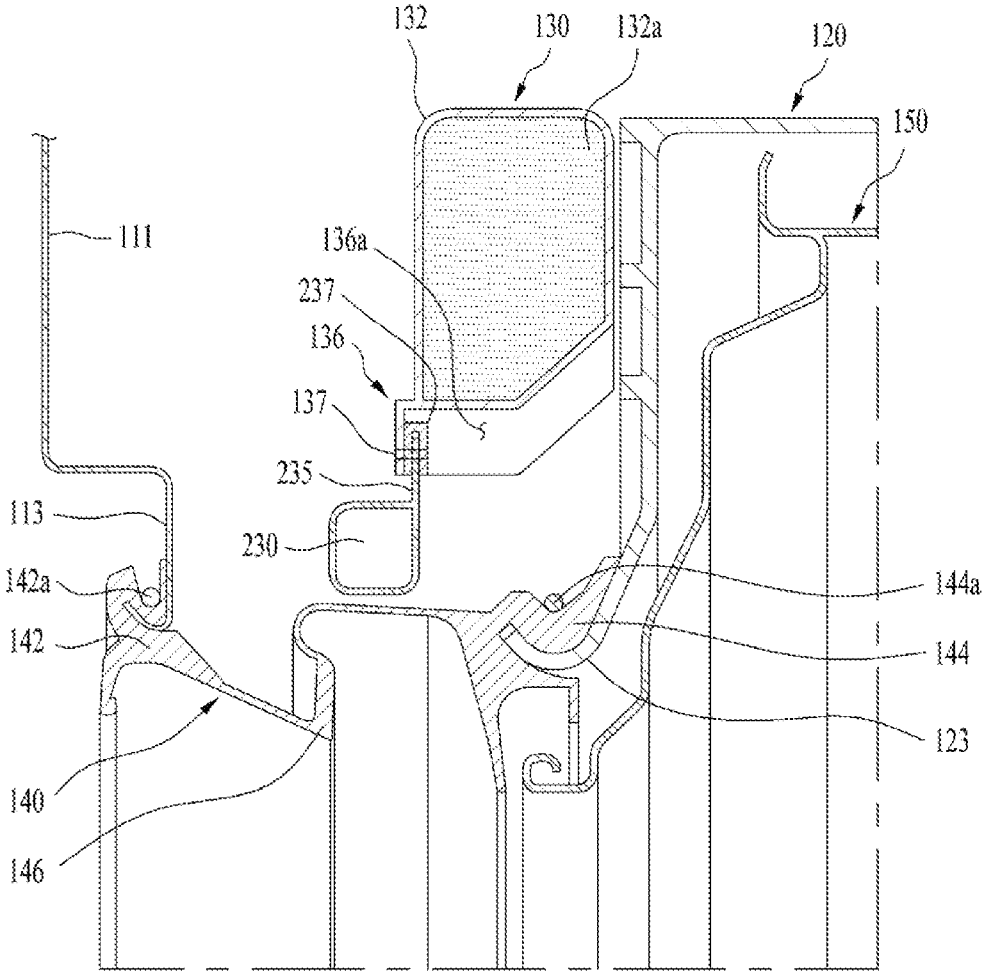
FIG. 6 is a cross-sectional diagram showing an installed state of an annular passage part according to an embodiment of the present invention.

Here, as shown in FIG. 5 and FIG. 6, the vibration insulating part 140 includes a cabinet fastening portion 142 provided to one side so as to be connected to the entrance rim 113 of the front panel 111, a tub fastening portion 144 provided to the other side so as to be connected to the opening rim 123 of the tub opening 122, and a bellows portion 146 of a bellow type formed between the cabinet fastening portion 142 and the tub fastening portion 144. Portions 142*a* and 144*a* are also positioned.

The vibration insulating part 140 may be formed of flexible material such as rubber to attenuate vibration transferred from the tub 120 to the cabinet 110. Furthermore, vibration can be attenuated more effectively through the vibration insulating part 140 projected from a circumference of the bellows portion 146 in a direction of a normal line thereof.

Moreover, a plurality of diffusion nozzle portions 148 are formed in an inner circumference of the vibration insulating part 140 so as to spray wash water into the drum 150 by being connected to the annular passage part 200. Each of the diffusion nozzle portions 148 is configured to diffusively spray wash water to a different position within the drum 150.

Figure 7:
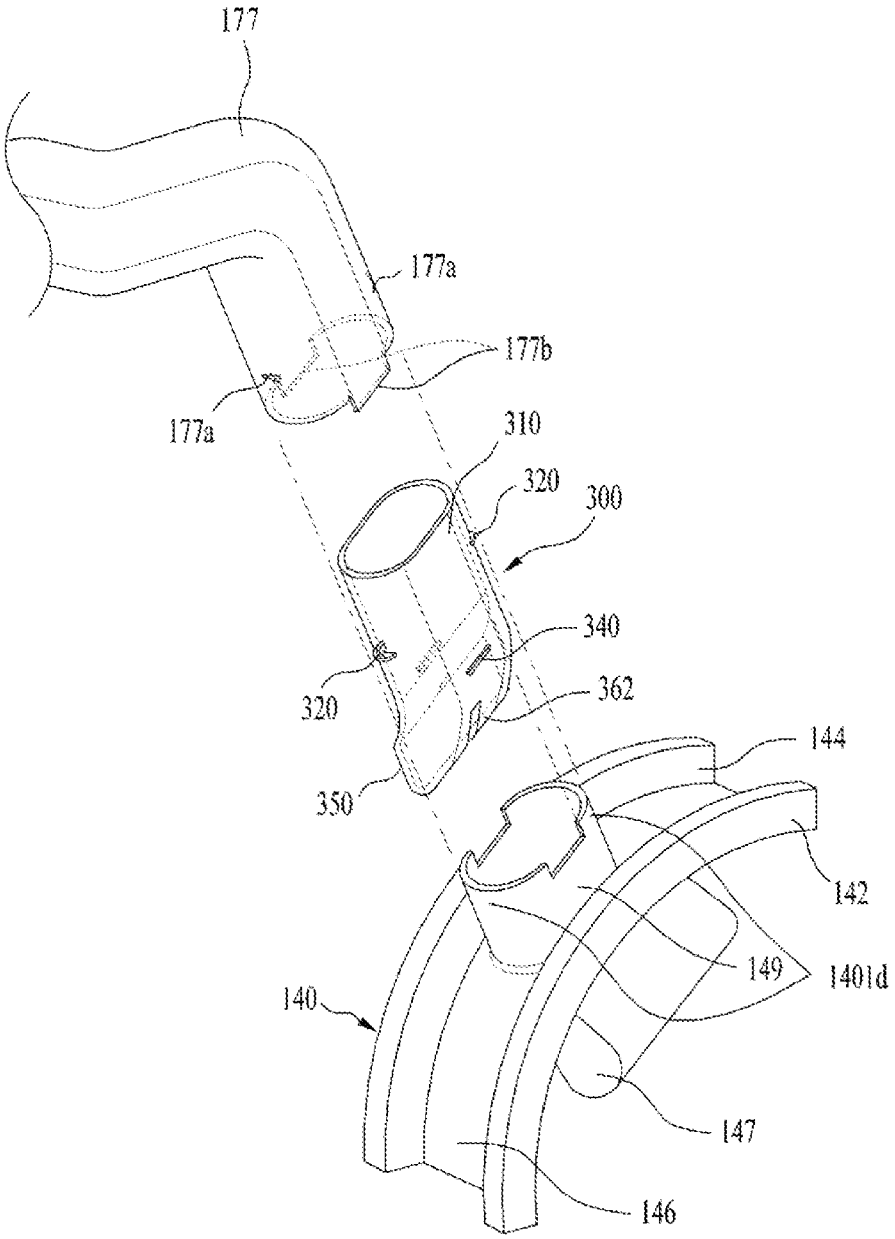
FIG. 7 is an exploded perspective diagram showing a water supply structure of a laundry treating apparatus according to an embodiment of the present invention.

Moreover, as shown in FIG. 7, a wash water inflow portion 149 with portions 1401*d* and configured to guide wash water to the drum 150 from the front side of the tub 120 may be provided to a top side of the vibration insulating part 140.

Here, the wash water inflow portion 149 may be provided to perforate a circumference of the bellows portion 146, incline to a left or right side with reference to a center of a left-right width direction of the bellows portion 146, and be provided to an upper side with reference to a height direction center of the bellows portion 146.

Besides, the wash water inflow portion 149 may be formed of the same material of the bellows portion 146. And, the wash water inflow portion 149 may be integrally formed with the bellows portion 146.

Meanwhile, a rotatable shaft 124 perforating the rear side of the tub 120 is provided to the rear side of the tub 120 in a manner of being rotatably supported by a bearing housing (not shown), and the rotatable shaft 124 is connected to a spider of the rear side of the drum 150 located within the tub 120. The rotatable shaft 124 is connected to the motor 160 provided to an outer surface of the rear side of the tub 120.

Here, the motor 160 may include a stator 162 fixed to the rear side of the tub 120 and a rotor 164 formed on an outer circumference of the stator 162 so as to be connected to the rotatable shaft 124. In case of the motor 160, various embodiments are available and details shall be omitted.

The water supply part 170 is provided above the tub 120 to supply wash water supplied from an external wash water supply source (not shown) to the tub 120. The water supply part 170 includes a water supply valve 172 and a water supply hose 174.

Here, the water supply hose 174 of the water supply part 170 may further include a detergent supplier 176 configured to mix detergent, fabric softener, bleach and the like, which are separately supplied together with the wash water supply, with the wash water and supply the mixed to the tub 120.

Here, the detergent supplier 176 is provided to a top end of the front side of the cabinet 110 and configured in the form of a drawer pulled out in a front direction. The detergent supplier 176 may be provided to one side of the front control panel of the cabinet 110. Regarding the detergent supplier 176, a portion for putting and storing a detergent and a portion exposed in a front direction may be integrally formed or a portion forming at least one portion of the front side may be configured as a separate part so as to be coupled thereto.

Meanwhile, the detergent supplier 176 may further include a detergent box 176*a* for putting a detergent and a water supply pipe 177 connecting the detergent box 176*a* to the wash water inflow portion 149 formed in the vibration insulating part 140.

Here, the water supply pipe 177 is provided to one side of the detergent box 176*a* and can be connected to the detergent box 176*a* through a water supply pipe connecting portion 179 formed under the detergent box 176*a*.

Meanwhile, the water supply pipe 177 may be formed of a flexible material having elasticity, which plays a role in attenuating vibration transferred from the tub 120 to the detergent box 176*a* fixed to an inside of the cabinet 110.

A water supply hose connecting portion 176*c* connected to the water supply hose 174 may be provided to the rear side of the detergent box in a manner of perforating the detergent box 176*a*.

According to the above-described configuration, since wash water can be supplied into the drum 150 through the detergent box 176*a*, a washing or rinsing cycle can be progressed while laundry is sufficiently soaked in the wash water.

Moreover, a detergent put into the detergent supplier 176 can easily flow into the tub 120 through the water supply pipe 177 by being diluted in the wash water supplied through the water supply hose 174.

Meanwhile, a balance weight 130 for attenuating the vibration of the tub 120 by increasing the weight of the tub 120 is provided to each of a front surface 121 and a rear surface of the tub 120. Here, the balance weight 130 may be located on an outside of the vibration insulating part 140.

Moreover, a plurality of fastening bosses (not shown) for installation of the balance weight 130 are formed on the front surface 121 and rear surface of the tub 120, and the balance weight 130 can be fastened to the fastening bosses by separate fastening members (not shown).

Here, the balance weight 130 may be installed on each of the front surface 121 and the rear surface with a different weight, shape, and disposition. The balance weight 130 may have a shape corresponding to a shape of the front surface 121 of the tub 120 and can be installed on the front surface 121 in a ring shape in a manner of being separated into at least one or more pieces.

Namely, the balance weight 130 may be formed in a ring shape or a circular arc shape corresponding to a shape (i.e., an outer side of the opening rim 123 formed at the tub opening 122 and an inner side of an outer circumference of the tub 120) of the front surface 121 formed on the front side of the tube 120.

In case that the balance weight 130 is installed on the front side of the tub 120, it can be installed by being separated into 2 pieces bilaterally symmetric to each other for the balance of right and left. Moreover, a grove in a specific shape may be further formed to avoid interference with a component (e.g., an air supply part (not shown), a wash water supply part (not shown), etc.) formed on the front side of the tub 120.

Meanwhile, as shown in FIG. 5, the balance weight 130 includes a housing 132 forming an exterior of the balance weight 130 and having a space portion formed therein and a weight material 132*a* playing a role as a weight body of the balance weight 130 in a manner of being injected into the housing 132 through an inlet (not shown) formed at the housing 132, filling an inside of the housing 132 completely, and then being hardened.

Here, the housing 132 is formed of a plastic material by injection molding and has an inner space formed therein to be filled with the weight material 132*a*. And, a plurality of tub fastening portions 134 are formed at positions of the housing 132, which correspond to the fastening bosses formed on the front surface 121 of the tub 120, by being separated from the inner space.

Particularly, the balance weight 130 may include a first balancer 130*a* and a second balancer 130*b* provided to both sides with reference to a right-left width direction center of the tub 120, respectively. Here, the first and second balancers 130*a* and 130*b* may be provided to a top side and a bottom side with reference to a height direction center of the tub 120, respectively.

Meanwhile, the water supply pipe 177 may pass in front of the first balancer 130*a*. In this case, as the tub 120 vibrates, it may cause a problem of an occurrence of friction or collision between the first balancer 130*a* and the water supply pipe 177. If the friction or collision between the water supply pipe 177 and the first balancer 130*a* keeps occurring, it causes a problem that the water supply pipe 177 may be broken due to abrasion or shock.

To prevent such problems, a water supply pipe avoiding portion 139 recessed in a front direction of the tub 120 may be formed in the first balancer 130*a*. The water supply pipe avoiding portion 139 may be configured in a shape corresponding to that of an outer circumference of the water supply pipe 177 and spaced apart in a prescribed distance from a backside of the water supply pipe 177 to the rear side to prevent collision more effectively.

Moreover, the drain part 180 is provided under the tub 120 so as to externally discharge the wash water after completing washing and rinsing or the wash water generated from dewatering from the tub 120.

Here, the drain part 180 includes a drain pipe 182 connected to a bottom of the tub 120 so as to collect and drain wash water within the tub 120, a drain chamber 184 temporarily storing wash water drained through the drain pipe 182, a drain pump 186 connected to one side of the drain chamber 184 to drain wash water, and a drain hose 186*a* connected to the drain pump 186 to discharge wash water out of the laundry treating apparatus 100.

Moreover, the drain part 180 can supply some of the wash water discharged to the drain chamber 184 to the annular passage part 200 and circulate the supplied wash water. The drain part 180 includes a circulating pump 188 connected to the other side of the drain chamber 184 so as to circulate wash water of the drain chamber 184 and a circulating hose 188*a* guiding wash water moved by the circulating pump 194 to the annular passage part 200.

The drum 150 is rotatably provided within the tub 120 in a state of having a rotational axis side by side with the tub 120, and a drum opening 152 having the same axis of the tub opening 122 is formed on the front side of the drum 150.

The drum 150 includes a plurality of perforated holes 156 configured to perforate the outer circumference. Through the perforated holes 156, wash water stored in the tub 120 can flow into the drum 150 or water discharged from laundry can be discharged to the inner space of the tub 120. Meanwhile, a lifter 154 for agitating laundry on rotation of the drum 150 may be further provided to the inner circumference of the drum 150.

Therefore, through the entrance 112, the tub opening 122 and the drum opening 152, a user can put laundry into the inner space of the drum 150 or pull the laundry out of the inner space of the drum 150.

Meanwhile, the above-described laundry treating apparatus 100 according to one embodiment of the present invention further includes an annular passage part 200 progressing washing by circulating wash water stored in the tub 120.

Here, the annular passage part 200 is connected to the circulating pump 188 provided to the drain part 180 and the circulating passage, thereby spraying wash water into the drum through the wash water supplied through the circulating passage.

An installed state of the annular passage part 200 is described in detail with reference to the accompanying drawings as follows.

Figure 4:
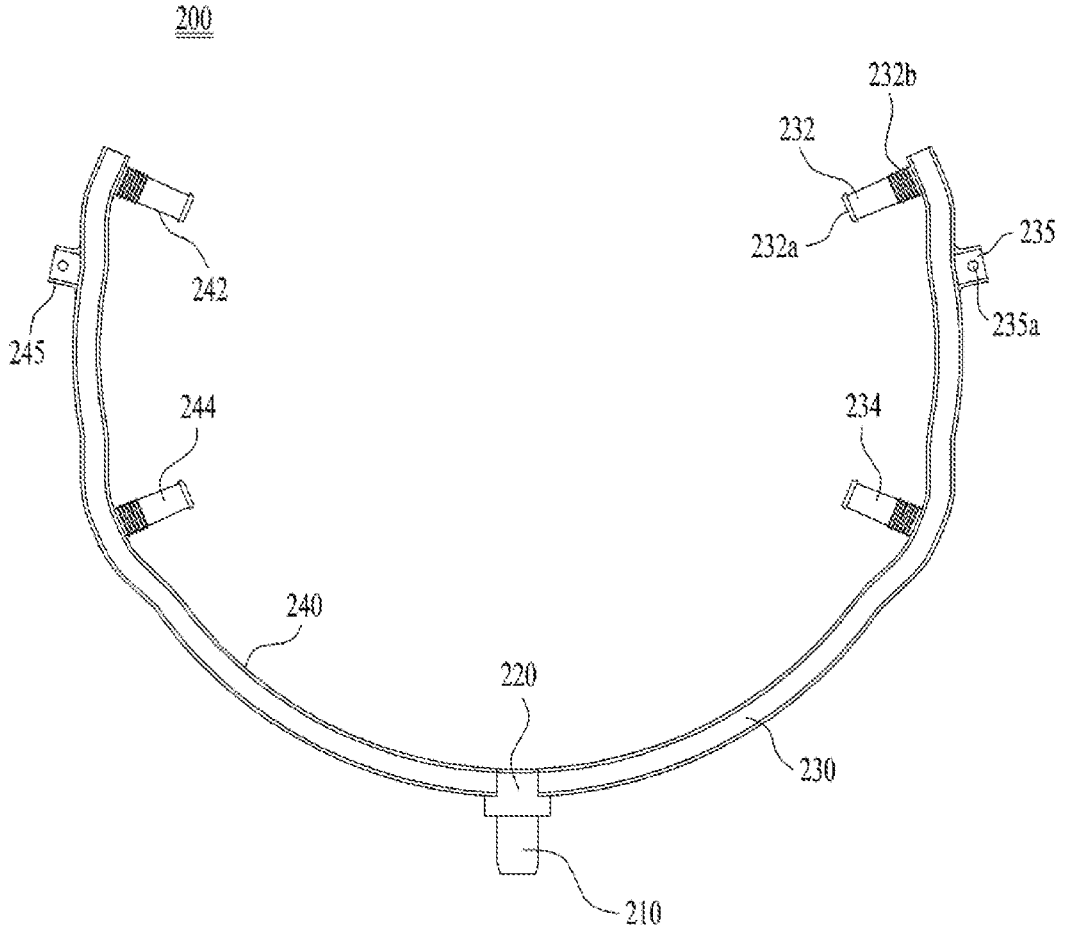
FIG. 4 is a front diagram showing an annular passage part according to an embodiment of the present invention.

FIG. 4 is a front diagram showing an annular passage part according to one embodiment of the present invention, FIG. 5 is a cross-sectional diagram showing an installed state of a nozzle of an annular passage part according to one embodiment of the present invention, and FIG. 6 is a cross-sectional diagram showing an installed state of an annular passage part according to one embodiment of the present invention.

Referring to FIGS. 4 to 6, the annular passage part 200 is installed between the vibration insulating part 140 connecting the tub opening 122 and the cabinet entrance 112 and the balance weight 130 located on the tub front surface 121.

The annular passage part 200 includes an inflow portion 210 having a bottom side connected to the circulating hose 188*a* of the drain part 180, and first and second extending portions 230 and 240 extending along an outer circumference of the vibration insulating part 140 are formed on a top side of the inflow portion 210.

Here, a connecting portion 220 is formed between the inflow portion 210 and the first and second extending portions 230 and 240 so as to connect the inflow portion 210 and the first and second extending portions 230 and 240 together and diverge to supply wash water flowing into the inflow portion 210 to the first and second extending portions 230 and 240.

Here, the first and second extending portions 230 and 240 are formed to be symmetric to each other centering on the connecting portion 220. Preferably, the first and second extending portions 230 and 240 are formed in a circular arc shape extending along a shape of the outer circumference of the vibration insulating part 140 centering on the connecting portion 220.

Meanwhile, a first end nozzle 232 and a first middle nozzle 234 projected in a center direction of the vibration insulating part 140 are formed at an end portion and a middle portion of the first extending portion 230 so as to be connected to a plurality of diffusion nozzle portions 148 formed at the vibration insulating part 140, respectively.

In a radial direction of the first extending portion 230, a first fixing rib 235 fixed to the balance weight 130 installed on the front surface of the tub 120 is formed by being projected.

And, a second end nozzle 242 and a second middle nozzle 244 projected in a center direction of the vibration insulating part 140 are formed at an end portion and a middle portion of the second extending portion 240 so as to be connected to a plurality of the diffusion nozzle portions 148 formed at the vibration insulating part 140, respectively. In a radial direction of the second extending portion 240, a second fixing rib 245 fixed to the balance weight 130 installed on the front surface of the tub 120 is formed by being projected.

Although the inflow portion 210 and the first and second extending portion 230 and 240 are described in a manner of being distinguished from each other for the functional features in describing the annular passage part 200, the inflow portion 210 and the first and second extending portion 230 and 240 can be formed integrally by injection molding according to a blower injection manufacturing method. Yet, the manufacturing method of the annular passage part 200 is non-limited. And, the inflow portion 210 and the first and second extending portion 230 and 240 may be manufactured as separate configurations and then assembled into an assembly.

Here, the first and second end nozzles 232 and 242, the first and second middle nozzles 234 and 244, and the first and second fixing ribs 235 and 245 can be formed in different shapes if necessary. Yet, if performing the functions examples in the present invention, they can be regarded as pertaining to the same scope.

Meanwhile, as shown in FIG. 5 and FIG. 6, the vibration insulating part 140 is provided between the tub opening 122 and the entrance 112 of the cabinet 110 to seal a space between the tub 120 and the cabinet 110 and to prevent the vibration of the tub 120 from being transferred to the cabinet 110.

Moreover, on an inner circumference of the tub fastening portion of the vibration insulating part 140, as shown in FIG. 5, a plurality of the diffusion nozzle portions 148 are formed so as to spray wash water into the drum 150 by being connected to the annular passage part 200.

Here, the diffusion nozzle portion 148 of the vibration insulating part 140 is provided with a nozzle sleeve 148*a* extending from the tub fastening portion 144 of the vibration insulating part 140 in a center direction of the vibration insulating part 140.

An insertion hole 148*b* in which the first end nozzle 232 is inserted is formed in the nozzle sleeve 148*a*. A diffusion plate 148*c* switching a direction of wash water discharged from the first end nozzle 232 to an inside of the drum 150 is formed on one side of the nozzle sleeve 148*a*.

Meanwhile, the diffusion plate 148*c* of each of the diffusion nozzle portions 148 is provided to spray wash water on a different position within the drum 150. Preferably, the diffusion nozzle portion 148 located at the top side of the vibration insulating part 140 can be made to spray wash water toward the rear side of the drum 150. And, the diffusion nozzle portion 148 located at the bottom side of the vibration insulating part 140 can be made to spray wash water toward the front side of the drum 150.

Moreover, a passage fastening part 136 is formed on one side of the housing 132 configuring the balance weight 130 to correspond to a position of each of the first and second fixing ribs 235 and 245 formed at the annular passage part 200.

The passage fastening part 136 includes a recess portion 136*a* recessed inward the housing 132 to enable each of the first and second fixing ribs 235 and 245 to be inserted therein, and a fastening hole 137 corresponding to a fastening hole formed in each of the first and second fixing ribs 235 and 245 is formed in a top side of the recess portion 136*a*.

A coupled state of the annular passage part 200 and the vibration insulating part 140 is described with reference to FIG. 5 as follows.

Here, the first and second end nozzles 232 and 242 and the first and second middle nozzles 234 and 244 formed at the first and second extending portions 230 and 240 of the annular passage part 200 can be formed in the same shapes. Hence, the following description is made by taking the fastening relation between the first end nozzle 232 of the first extending portion 230 and the diffusion nozzle portion 148 as a representative example.

First of all, the first end nozzle 232 is formed longer by a prescribed length than the nozzle sleeve 148*a* of the diffusion nozzle portion 148, and a catch sill 232*a* held on an end of the nozzle sleeve 148*a* is formed at an end of the first end nozzle 232.

Such a catch sill 232*a* has an inclined surface inclined in a direction opposite to an inserted direction of the nozzle sleeve 148*a* of the first end nozzle 232, whereby the first end nozzle 232 can be easily inserted in the nozzle sleeve 148*a*.

Moreover, after the first end nozzle 232 has been inserted in the nozzle sleeve 148*a*, the catch sill 232*a* of the first end nozzle 232 is held on the nozzle sleeve 148*a*, whereby the separation of the first end nozzle 232 can be prevented.

Moreover, on an inner circumference of the balance weight 130 located on an outside of the first end nozzle 232, a nozzle pressurizing surface 138, which is configured to pressurize the first end nozzle 232 in a manner that a portion of the inner circumference of the balance weight 130 adjacent with the first end nozzle 232 comes in contact with the first end nozzle 232, is formed.

Thus, the nozzle pressuring surface 138 of the balance weight 130 pressurizes the first end nozzle 232 after the balance weight 130 and the annular passage part 200 have been installed at the front surface 121, whereby the first end nozzle 232 can be prevented from being separated from the diffusion nozzle portion 148.

Moreover, in order to increase the frictional force of the nozzle sleeve 148*a* with the insertion hole 148*b* when the first nozzle 232 is inserted in the nozzle sleeve 148*a*, a plurality of separation-preventive ribs 232*b* protruding toward the inner circumference of the insertion hole 148*b* of the nozzle sleeve 148*a* can be further formed on an outer circumference of the first end nozzle 232.

A coupled state between the annular passage part 200 and the balance weight 130 is described with reference to FIG. 6 as follows.

Here, the first and second fixing ribs 235 and 245 formed at the first and second extending portions 230 and 240 of the annular passage part 200 can be formed in the same shape. Hence, the following description is made by taking the fastening relation between the first fixing rib 235 of the first extending portion 230 and the balance weight 130 as a representative example.

First of all, after the annular passage part 200 has been fastened to the vibration insulating part 140, the balance weight 130 is fastened to the front surface of the tub 120.

After the fastening of the balance weight 130, the first fixing rib 235 formed at the first extending portion 230 of the annular passage part 200 becomes adjacent to the passage fastening part 136 of the balance weight 130.

Thereafter, using a separate fastening member (not shown), the first fixing rib 235 of the annular passage part 200 and the fastening holes 137 formed at the passage fastening part 136 of the balance weight 130, whereby the annular passage part 200 can be fixed to the balance weight 130.

Moreover, by additionally providing a separate fastening clip 237 to the first fixing rib 235 of the annular passage part 200, the first fixing rib 235 and the fastening clip 237 are fastened together. Subsequently, the fastening hole 137 formed in the balance weight 130 and the fastening clip 237 are fastened together using a separate fastening member. Thus, the annular passage part 200 can be fixed to the balance weight 130.

As described above, in the laundry treating apparatus according to one embodiment of the present invention, the installation structure of the annular passage part 200 for spraying wash water into the drum can be simplified and the wash water can be sprayed into the drum 150 in a wider range.

A water supply structure according to one embodiment of the present invention is described in detail with reference to FIGS. 7 to 9 as follows.

Figure 8:
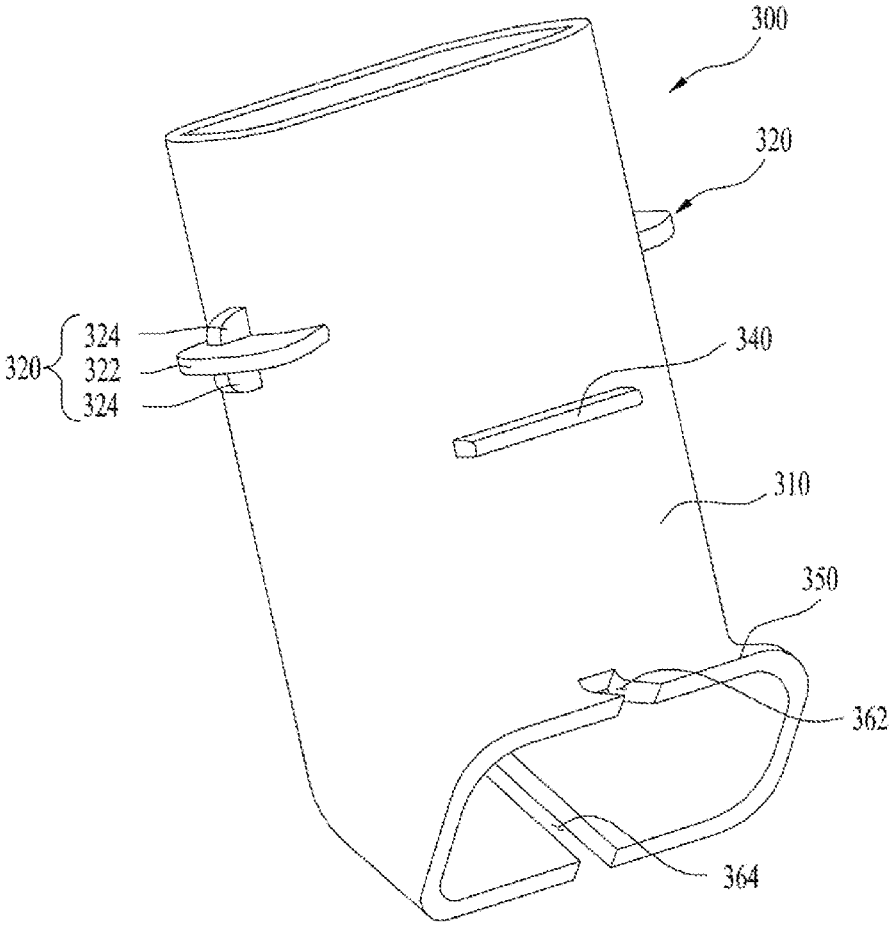
FIG. 8 is a perspective diagram showing a connector of a laundry treating apparatus according to an embodiment of the present invention.
Figure 9:
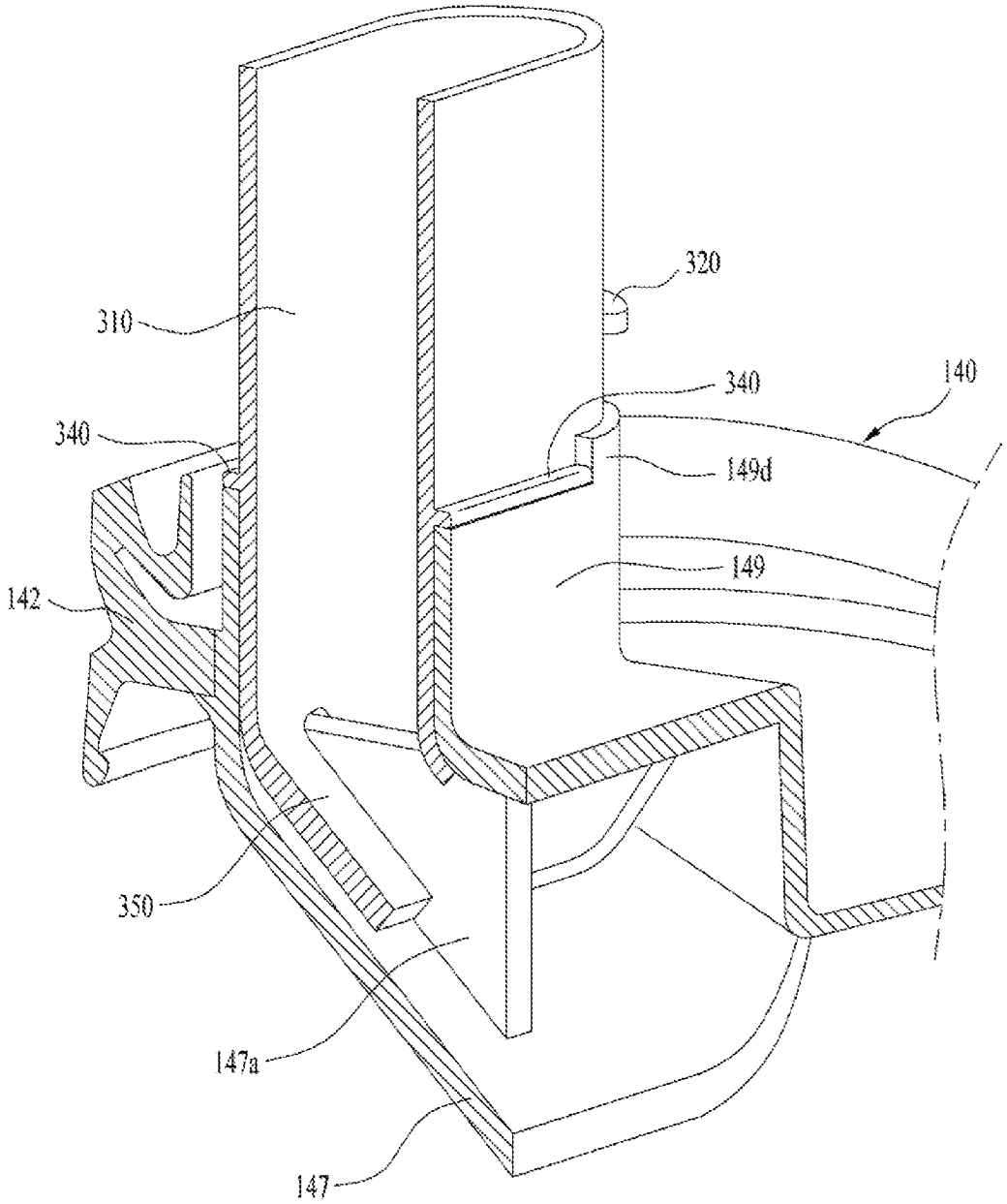
FIG. 9 is a diagram showing a connector and a wash water inflow portion of a laundry treating apparatus according to an embodiment of the present invention.

FIG. 7 is an exploded perspective diagram showing a water supply structure of a laundry treating apparatus according to one embodiment of the present invention, FIG. 8 is a perspective diagram showing a connector of a laundry treating apparatus according to an embodiment of the present invention, and FIG. 9 is a diagram showing a connector and a wash water inflow portion of a laundry treating apparatus according to an embodiment of the present invention.

An embodiment of a connection structure of the water supply pipe 177 and the wash water inflow portion 149 is described with reference to FIG. 7 and FIG. 4 as follows.

The laundry treating apparatus 100 according to an embodiment of the present invention may further include a connector 300 connecting the water supply pipe 177 of the detergent supplier 176 and the wash water inflow portion 149 of the vibration insulating part 140 together.

Here, the connector 300 may include a connector body 310 having a hollow, one portion of an outer circumference of the connector body 310 may be coupled to an inner circumference of the water supply pipe 177, and the other portion may be coupled to an inner circumference of the wash water inflow portion 149.

Accordingly, a worker who assembles parts into the laundry treating apparatus slides to insert the connector 300 into one of the water supply pipe 177 and the wash water inflow portion 149 and slides to couple the other to the connector 300, whereby the water supply pipe 177 and the wash water inflow portion 149 can be conveniently connected together.

Compared to a fixing manner using a clamp externally by fixing positions of the water supply pipe 177 and the wash water inflow portion 149, the above-described connection manner has the reduced assembly man-hour. Moreover, since there is no structure projected toward an outside of the water supply pipe 177, the above-described connection manner has an excellent effect of preventing collision with peripheral parts such as the weight balancer and the like.

Here, each of the water supply pipe 177 and the wash water inflow portion 149 is formed of expansible flexible material and the connector 300 may be formed of synthetic resin having rigidity higher than that of each of the water supply pipe 177 and the wash water inflow portion 149.

Thus, in comparison with the related art, the manufacturing cost of the connector 300 is reduced and molding is facilitated. When the connector 300 is inserted, each of the water supply pipe 177 and the wash water inflow portion 149 stretches in its width direction and then contracts back, whereby water tightness can be increased excellently.

Moreover, a wash water guider 147 extending from an inner circumference of the bellows portion 146 toward an inner space of the drum 150 can be provided. The wash water guider 147 plays a role in spreading the wash water flowing into the wash water inflow portion 149 toward an inside of the drum 150.

Namely, the wash water guider 147 enables the wash water to be sprayed from the front side of the tub 120 toward the inside of the drum 150, whereby a washing or rinsing cycle can be progressed in a state that laundry received in the drum 150 sufficiently keeps the wash water in itself.

The wash water inflow portion 149 may be provided before the vibration insulating part 140, whereby vibration generated from the tub 120 is attenuated by the vibration insulating part 140 and then transferred to the wash water inflow portion 149.

The connector 300 may further include a guider insertion portion 350 inserted in the wash water guider 147 by extending from one end of the connector body 310.

The guider insertion portion 350 may be bent at one end of the connector body 310 toward the inner space of the drum 150 and then extended. This can prevent a problem that the connector 300 is separated from the wash water inflow portion 149 and also switch a moving direction of the wash water passing through the connector 300.

Moreover, a cut portion 362/364 may be provided to one end of the guider insertion portion 350. The cut portion 362/364 may be provided side by side with the direction in which the guide insertion portion 350 extends from the connector body 310.

Here, a circumference of the guider insertion portion 350 may be provided greater than that of the connector body 310. Hence, while a worker assembling the laundry treating apparatus 100 presses the guider insertion portion 350 to narrow the cut portion 362/364, the worker can insert the connector 300 by sliding the connector 300 into the wash water inflow portion 149.

Once the connector 300 is inserted in the wash water inflow portion 149, the cut portion 362/364 is widened again so that the guider insertion portion 350 pressurizes an inner circumference of the wash water guider 147. Namely, the cut portion 362/364 can increase water tightness between the guider insertion portion 350 and the wash water guider 147 and strengthen the fastening force between the two.

Moreover, the cut portion 362/364 may include at least one of a first cut portion 362 provided to a bottom surface of the guider insertion portion 350 and a second cut portion 364 provided to a top surface of the guider insertion portion 350.

Meanwhile, the water supply pipe 177 may further include a water supply pipe step difference portion **177*b*, and the water supply pipe step different portion 177*b* may protrude from an end of the water supply pipe 177**.

Moreover, the wash water inflow portion 149 may further include an inflow portion step difference portion **149*d* extending toward the water supply pipe 177 and the inflow portion step difference portion 149*d* may protrude from an end of the wash water inflow portion 149** as well.

Here, the inflow portion step difference portion 149*d* may be configured in a shape engaging with a portion of the water supply pipe 177 at which the water supply pipe step difference portion 177*b* is not located.

Hence, as a shear stress, which is applied to the connector 300 by the wash water inflow portion 149 and the water supply pipe 177 when the tub 120 vibrates, is dispersed to top and bottom of the connector 300, it is able to prevent a problem that the connector 300 may be possibly broken or damaged by the vibration of the tub 120.

Meanwhile, the connector 300 may further include a first coupling portion 320 protruding in a normal direction of a circumference of the connector body 310 so as to be coupled to the water supply pipe 177, and a first coupling portion receiving portion 177*a* coupled to the first coupling portion 320 may be formed on the inner circumference of the water supply pipe 177.

Here, the first coupling portion 320 and the first coupling portion receiving portion 177*a* strengthens the coupling force between the connector body 310 and the water supply pipe 177, thereby preventing a problem that the water supply pipe 177 is separated from the connector body 310.

Moreover, the first coupling portion 320 may be formed as at least one coupling projection 322, and a pair of supplementary projections 324, which are relatively smaller than the first coupling projection 322 and extend in top and bottom directions, may be provided to top and bottom sides of the first coupling projection 322, respectively. Here, an end corer of each of the supplementary projection s 324 may include a curved surface.

The first coupling portion receiving portion 177*a* may include at least one insertion hole perforating a circumference of the water supply pipe 177.

Hence, as the inner circumference of the water supply pipe 177 smoothly slides on the corner of the supplementary projection 320, the first coupling projection 322 can be inserted in the first coupling portion receiving portion 177*a*. Likewise, the supplementary projection may be provided to the bottom side of the first coupling projection 320 as well, which enables the first coupling projection 322 to be smoothly separated from the first coupling portion receiving portion 177*a*.

In the following, specific configurations of the water supply structure shall be described in detail with reference to FIG. 9 that is a cross-sectional diagram along a cut line in a length direction of the connector.

First of all, the connector 300 may further include a movement preventive sill 340 provided to the connector body 310 and located between the water supply pipe 177 and the wash water inflow portion 149.

The movement preventive sill 340 may include a rib extending in a width direction of the connector 300 by being projected from the height direction center of the connector 300.

Hence, when the wash water inflow portion 149 and the water supply pipe 177 are connected to the connector 300, it is able to prevent a problem that one of the wash water inflow portion 149 and the water supply pipe 177 is excessively inserted in the connector 300.

Moreover, a cut portion insertion portion 147*a* received in the cut portion 362/364 of the guider insertion portion 350 may be further included in the inner circumference of the wash water guider 147.

Here, the cut portion insertion portion 147*a* may include an insertion rib and may have a width equal to or greater than that of the cut portion 362/364. The cut portion insertion portion 147*a* can play a role in physically restricting a depth at which the guider insertion portion 350 is inserted in the wash water guider 147.

A water supply structure according to another embodiment of the present invention is described in detail with reference to FIG. 10 and FIG. 11 as follows.

Figure 10:
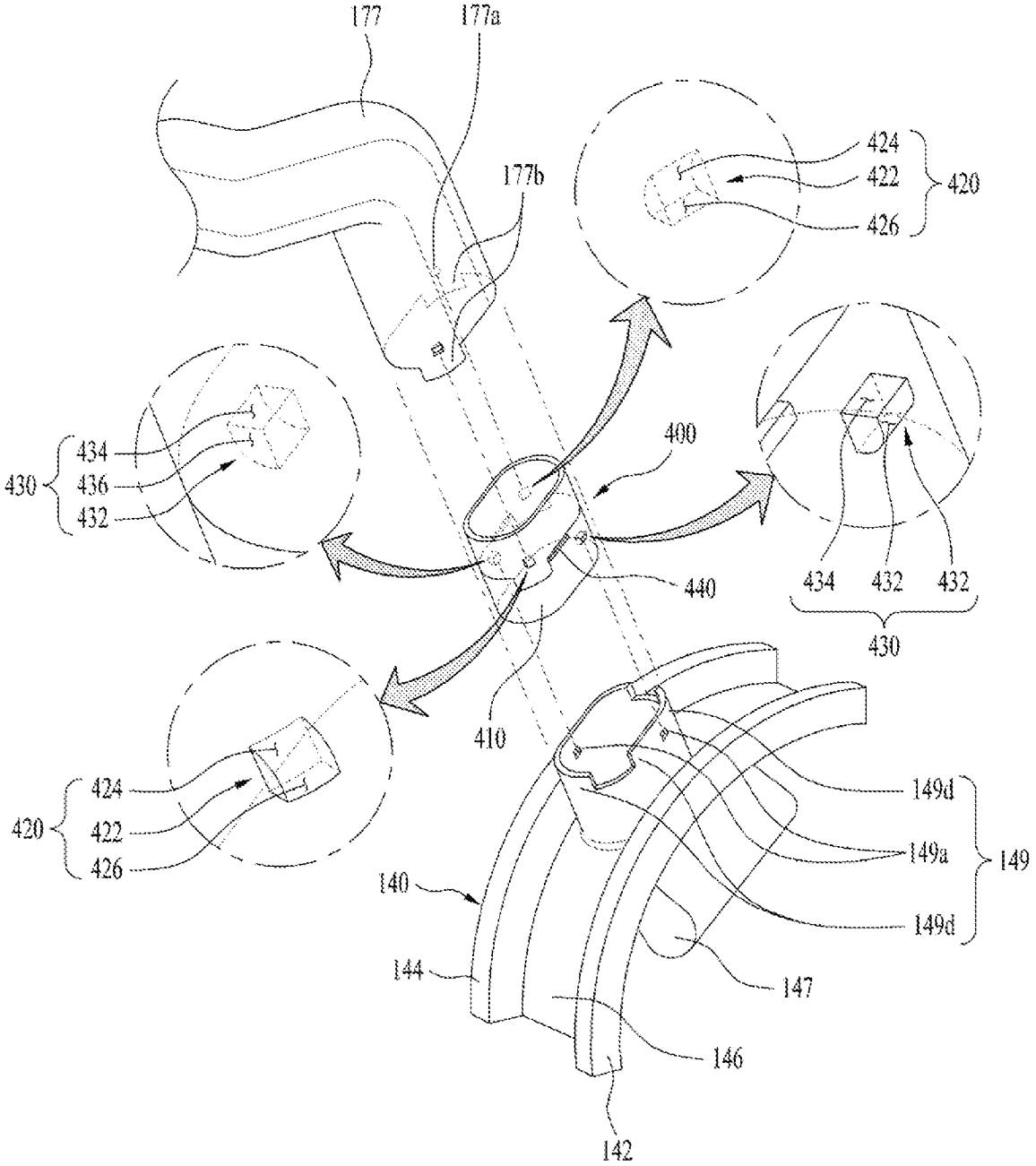
FIG. 10 is an exploded perspective diagram showing a water supply structure of a laundry treating apparatus according to another embodiment of the present invention.
Figure 11:
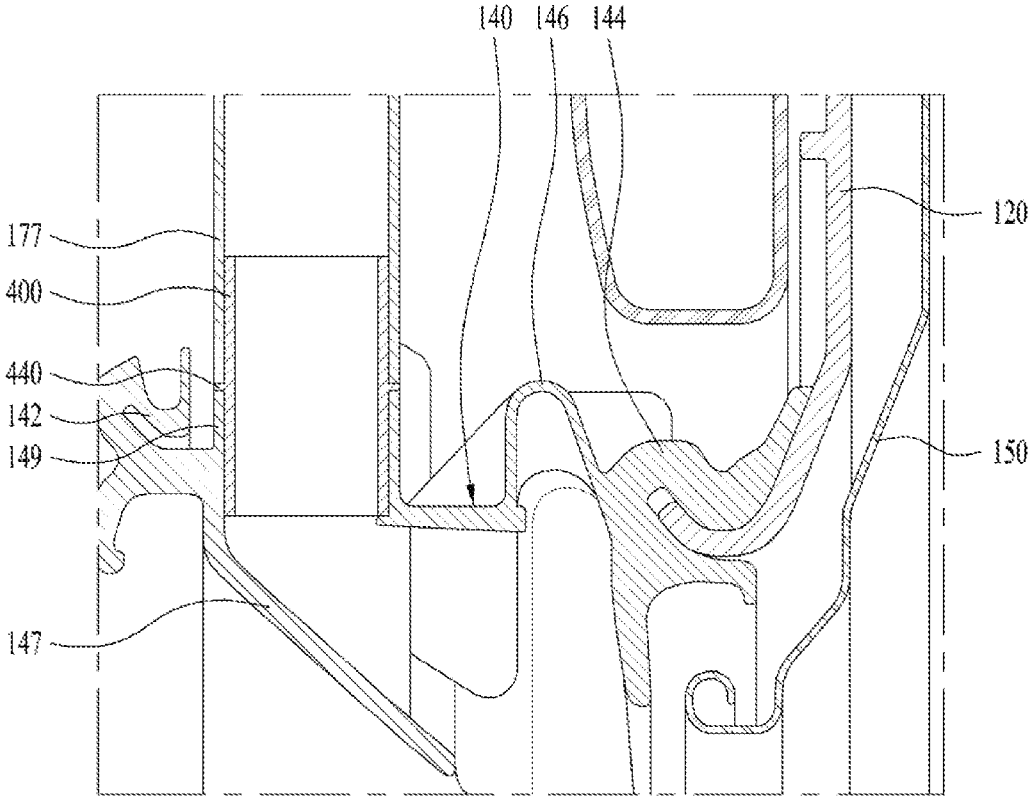
FIG. 11 is a cross-sectional diagram showing a fastened state of a connector in a laundry treating apparatus according to another embodiment of the present invention.

FIG. 10 is an exploded perspective diagram showing a water supply structure of a laundry treating apparatus according to another embodiment of the present invention, and FIG. 11 is a cross-sectional diagram showing a fastened state of a connector in a laundry treating apparatus according to another embodiment of the present invention.

To avoid redundant description, the following description is made centering on configurations added to the above-described embodiment.

A connector 400 according to another embodiment of the present invention may further include a first coupling portion 420 projected in a normal direction of a circumference of a connector body 410 having portion 440 and coupled to the water supply pipe 177 and a second coupling portion 430 coupled to the wash water inflow portion 149. Here, the second coupling portion 430 may be provided to a position lower than that of the first coupling portion 420.

Meanwhile, a first coupling portion receiving portion 177*a* coupled to the first coupling portion may be formed in the water supply pipe 177. And, the first coupling portion receiving portion 177*a* may include at least one insertion hole perforating the circumference of the water supply pipe 177.

Here, the first coupling portion 420 and the first coupling portion receiving portion 177*a* strengthen the coupling force between the connector body 410 and the water supply pipe 177, thereby preventing a problem that the water supply pipe 177 is separated from the connector body 310.

Moreover, the first coupling portion 420 may be provided as at least one first coupling projection 422. The first coupling projection 422 may include a first bottom surface 426 vertical to the circumference of the connector body 410 and a first top surface 424 inclined upward toward the circumference of the connector body 410 from an end of the first bottom surface 426.

Accordingly, as the inner circumference of the water supply pipe 177 slides along the first top surface 424, the first coupling projection 422 can be naturally inserted in the first coupling portion receiving portion 177*a* and supported by the first bottom surface 426.

Moreover, the wash water inflow portion 149 may include a second coupling portion receiving portion 149*a* coupled to the second coupling portion 430. And, the second coupling portion receiving portion 149*a* may include at least one insertion hole perforating the circumference of the wash water inflow portion 149.

Here, the second coupling portion 430 and the second coupling portion receiving portion 149*a* strengthen the coupling force between the connector body 410 and the wash water inflow portion 149, thereby preventing a problem that the wash water inflow portion 149 is separated from the connector body 310.

Moreover, the second coupling portion 430 may be provided as at least one second coupling projection 432. The second coupling projection 432 may include a second top surface 434 vertical to the circumference of the connector body 410 and a second bottom surface 436 inclined downward toward the circumference of the connector body 410 from an end of the second top surface 434.

Accordingly, as the inner circumference of the wash water inflow portion 149 slides along the second bottom surface 436, the second coupling projection 432 can be naturally inserted in the second coupling portion receiving portion 149*a* and supported by the second top surface 434.

A plurality of the first coupling portions 420, a plurality of the second coupling portions 430, a plurality of the first coupling portion receiving portions 177*a* and a plurality of the second coupling portion receiving portion 149*a* may be provided. In this case, the mutual coupling force can be further increased.

A water supply structure according to further embodiment of the present invention is described in detail with reference to FIG. 12 and FIG. 13 as follows.

Figure 12:
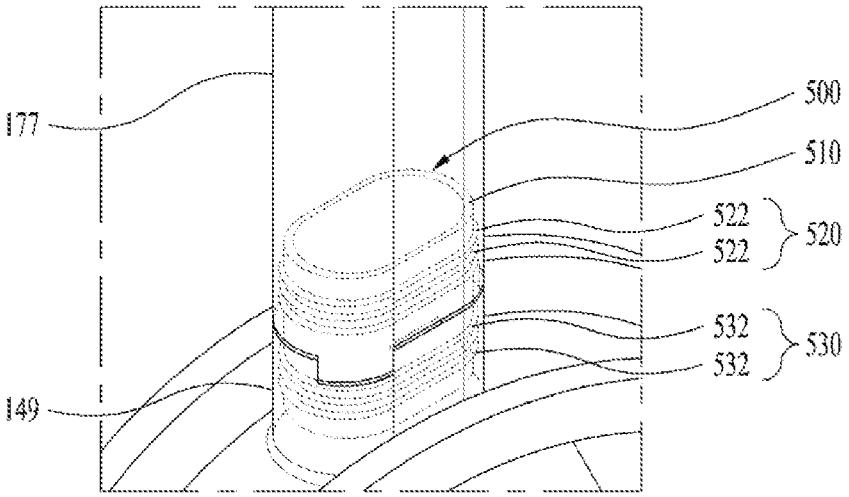
FIG. 12 is a perspective diagram showing a coupled state of a water supply pipe and a connector in a laundry treating apparatus according to another embodiment of the present invention.
Figure 13:
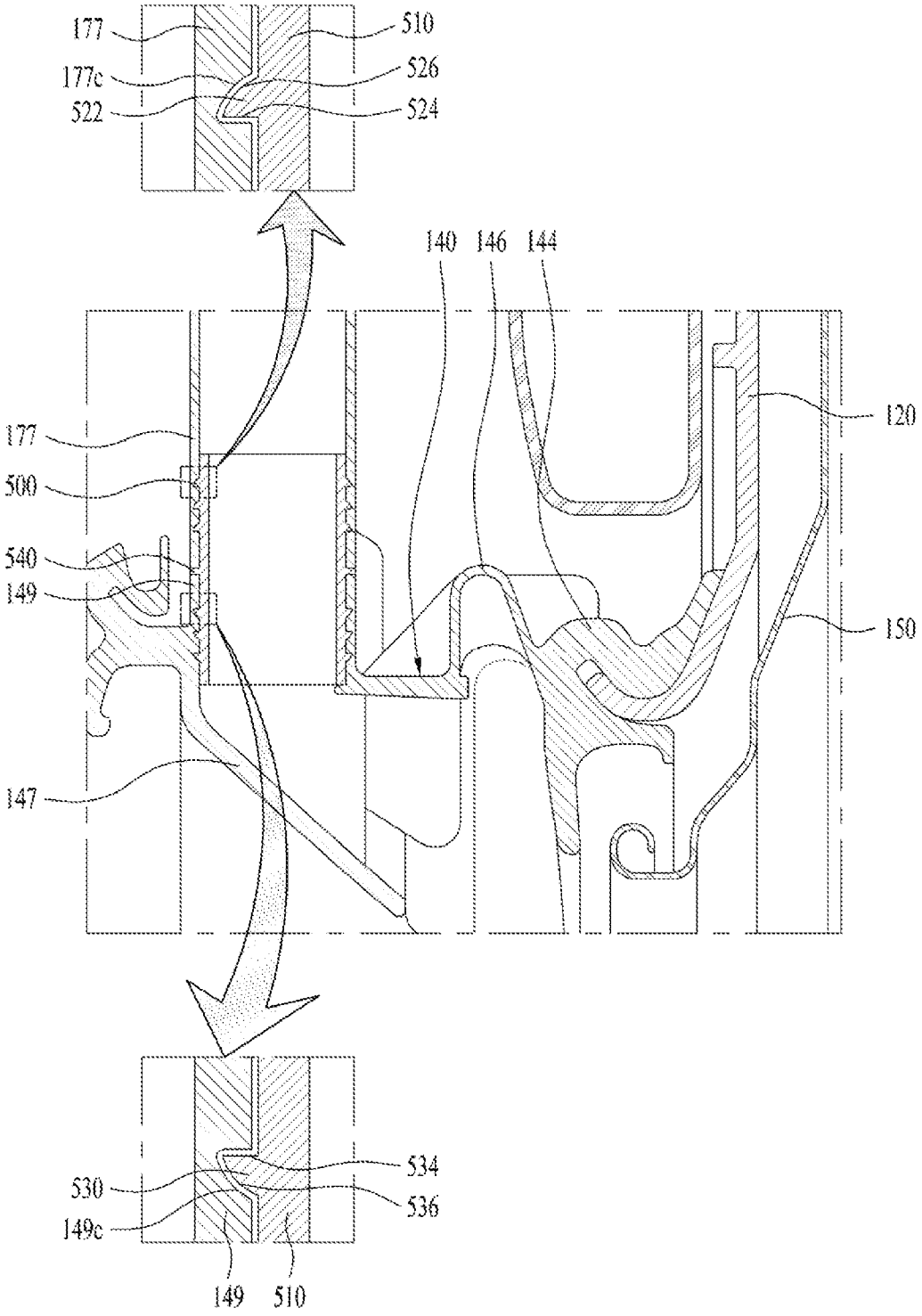
FIG. 13 is a cross-sectional diagram showing a coupled state of a water supply pipe and a connector in a laundry treating apparatus according to another embodiment of the present invention.

FIG. 12 is a perspective diagram showing a coupled state of a water supply pipe and a connector in a laundry treating apparatus according to further embodiment of the present invention, and FIG. 13 is a cross-sectional diagram showing a coupled state of a water supply pipe and a connector in a laundry treating apparatus according to further embodiment of the present invention.

To avoid redundant description, the following description is made centering on configurations added to the above-described embodiment.

A connector 500 according to further embodiment of the present invention may further include a first coupling portion 520 extending along a circumference from a top side of a connector body 510 so as to be inserted in the water supply pipe 177 and a second coupling portion 530 extending along the circumference from a bottom side of the connector body 510 so as to be inserted in the wash water inflow portion 149.

Here, the first coupling portion 520 may include a plurality of first coupling ribs 522 extending along the circumference from the top side of the connector body 510 and each of the first coupling ribs 522 enables the water supply pipe 177 and the connector 500 to be coupled to each other tightly.

Namely, as the first coupling rib 522 pressurizes the inner circumference of the water supply pipe 177 formed of a flexible material, the coupling force and water tightness between the water supply pipe 177 and the connector 500 can be increased.

Moreover, the second coupling portion 530 may include a plurality of second coupling ribs 532 extending along the circumference from the bottom side of the connector body 510 and each of the second coupling ribs 532 enables the wash water inflow portion 149 and the connector 500 to be coupled to each other tightly.

Namely, as the second coupling rib 532 pressurizes the inner circumference of the wash water inflow portion 149 formed of a flexible material with portion 540, the coupling force and water tightness between the wash water inflow portion 149 and the connector 500 can be increased.

Meanwhile, since both of the water supply pipe 177 and the wash water inflow portion 149 are formed of flexible material and adhere closely to the curved surfaces of the first and second coupling ribs 522 and 532, separate grooves for holding the first and second coupling ribs 522 and 532 may not be formed in the inner circumferences of the water supply pipe 177 and the wash water inflow portion 149, respectively.

Meanwhile, the first coupling rib 522 may include a first bottom surface 524 vertical to a circumference of the connector body 510 and a first top surface 526 inclined upward toward the circumference of the connector body 510 from an end of the first bottom surface 524.

Moreover, the second coupling rib 532 may include a second bottom surface 534 vertical to a circumference of the connector body 510 and a second top surface 536 inclined downward toward the circumference of the connector body 510 from an end of the second top surface 534.

The inclined structures of the first top surface 526 and the second bottom surface 536 of the first and second coupling portions 520 and 530 facilitates the connector 500 to be inserted in the water supply pipe 177 and the wash water inflow portion 149.

Moreover, a plurality of the first coupling ribs 522 and a plurality of the second coupling ribs 532 may be provided along a height direction of the connector 500, which maximizes the aforementioned effects.

Meanwhile, a first coupling portion receiving portion 177*a* and a second coupling portion receiving portion 149*a* coupled to the first coupling rib 522 and the second coupling rib 532 may be further provided to the water supply pipe 177 and the wash water inflow portion 149, respectively.

Particularly, the first coupling portion receiving portion 177*a* may include a first coupling rib receiving groove 177*c* configured in a manner that the inner circumference of the water supply pipe 177 is recessed in a normal direction thereof. Here, the first coupling rib receiving groove 177*c* may be configured in a shape corresponding to the first coupling rib 522 in a manner of being recessed along the inner circumference of the water supply pipe 177.

Moreover, the second coupling portion receiving portion 149*a* may include a second coupling rib receiving groove 149*c* configured in a manner of being recessed from the inner circumference of the wash water inflow portion 149 in a normal direction thereof. Here, the second coupling rib receiving groove 149*c* may be configured in a shape corresponding to the second coupling rib 532 in a manner of being recessed along the inner circumference of the wash water inflow portion 149.

In this case, a plurality of the first coupling rib receiving grooves 177*c* and a plurality of the second coupling rib receiving grooves 149*c* may be provided to correspond to the number of the first coupling ribs 522 and the number of the second coupling ribs 532, respectively.

Embodiments for the above-described connection structures between the water supply pipe 177 and the wash water inflow portion 149 can be implemented in a mutually complex manner. In this case, the coupling force among the connector 300/400/500, the water supply pipe 177 and the wash water inflow portion 149 can be further increased.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for treating laundry, comprising:

a cabinet having an entrance for inserting laundry and a door opening and closing the entrance;

a tub positioned in the cabinet and having an opening for allowing the laundry to pass through;

a drum rotatably positioned in the tub to receive the laundry;

a vibration insulating part maintaining a watertight seal by connecting the entrance to the opening;

a balance weight positioned at a front side of the tub to increase a weight of the tub; and an annular passage part extending between the vibration insulating part and the balance weight, the annular passage part fixedly supported by the balance weight, the annular passage part having a plurality of nozzles spraying wash water into the drum through the vibration insulating part, wherein the annular passage part comprises:

an inflow portion supplied with the wash water;

first and second extending portions extending to both sides of the outer circumference of the vibration insulating part;

a connecting portion positioned between the first and second extending portion and the inflow portion to divergently supply the wash water supplied to the inflow portion to the first and second extending portions; and a fixing rib formed on an outer surface of each of the first and second extending portions, wherein the nozzles are each positioned at the first and second extending portions to spray the wash water into the drum by perforating the vibration insulating part, and the nozzles comprise:

an end nozzle protruding toward the center of the vibration insulating part from the end of each of the first and second extending portions, and a middle nozzle protruding toward the center of the vibration insulating part from the middle of each of the first and second extending portions, and wherein the balance weight comprises:

a surface pressurizing the nozzles toward the vibration insulating part by contacting an outer surface of the nozzles; and fastening portions formed on the balance weight and corresponding to positions of the fixing ribs.

2. The apparatus of claim 1, wherein the vibration insulating part comprises a diffusion nozzle portion having the nozzles inserted therein, the diffusion nozzle portion diffusing the wash water sprayed from the nozzles when switching a direction of the wash water to an inside of the drum.

3. The apparatus of claim 2, the diffusion nozzle portion comprising:

a nozzle sleeve having insertion holes where the nozzles are inserted; and a diffusion plate formed on one side of the nozzle sleeve, the diffusion plate diffusing the wash water sprayed from the nozzles when switching the direction of the wash water to the inside of the drum.

4. The apparatus of claim 3, wherein each of the nozzles further comprises a catch sill held on an end of the nozzle sleeve and inserted in the nozzle sleeve.

5. The apparatus of claim 3, wherein a plurality of separation preventive ribs configured to increase a frictional force with an inner circumference of the nozzle sleeve are formed on an outer circumference of each of the nozzles.

6. The apparatus of claim 1, wherein each fastening portion comprises:

a recessed portion recessed in an inside of the balance weight and having one of the fixing rib inserted therein; and a fastening hole formed in the recessed portion so that a fastening member fixing the fixing rib is inserted in the fastening hole.

7. The apparatus of claim 6, further comprising a fastening clip that fastens the fastening member perforating the fastening hole by interposing the fixing rib.

8. The apparatus of claim 1, further comprising:

a water supply pipe for supplying the wash water;

a wash water inflow portion provided at an outer circumference of the vibration insulating part to guide the wash water into the drum; and a connector connecting the water supply pipe and the wash water inflow portion together by being inserted in the water supply pipe and the wash water inflow portion.

9. The apparatus of claim 8, wherein the connector includes a connector body configured in a hollow pillar shape.

10. The apparatus of claim 9, wherein the connector further includes a movement preventive sill positioned at the connector body and contacting an end portion of the water supply pipe and an end portion of the wash water inflow portion.

11. The apparatus of claim 9, wherein the connector further includes a first coupling portion positioned at the connector body to be coupled to the water supply pipe by being projected from an outer circumference of the connector body.

12. The apparatus of claim 11, wherein the first coupling portion includes a first coupling projection, and wherein the water supply pipe includes a first coupling projection insertion hole having the first coupling projection inserted therein.

13. The apparatus of claim 11, wherein the first coupling portion includes a first coupling rib continuously protruding along the outer circumference of the connector body.

14. The apparatus of claim 11, wherein the connector further includes a second coupling portion positioned at the connector body and coupled to the wash water inflow portion by being projected from an outer circumference of the connector body.

15. The apparatus of claim 14, wherein the second coupling portion includes a second coupling projection, and wherein the wash water inflow portion includes a second coupling projection insertion hole having the second coupling projection inserted therein.

16. The apparatus of claim 14, wherein the second coupling portion includes a second coupling rib continuously protruding along the outer circumference of the connector body.

17. The apparatus of claim 9, further comprising a wash water guider positioned at an inner circumference of the vibration insulating part to form a passage communicating with the wash water inflow portion, the wash water guider bent toward an inner space of the drum, wherein the connector further comprises a guider insertion portion provided at an end of the connector body to be inserted in the wash water guider.

* * * * *